US006893315B2

(12) United States Patent
Barri

(10) Patent No.: US 6,893,315 B2
(45) Date of Patent: May 17, 2005

(54) TOY FIGURE WITH A MAGNETIZED JOINT

(75) Inventor: Darin Barri, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 99 days.

(21) Appl. No.: 10/639,902

(22) Filed: Aug. 12, 2003

(65) Prior Publication Data

US 2004/0077259 A1 Apr. 22, 2004

Related U.S. Application Data

(60) Provisional application No. 60/405,133, filed on Aug. 21, 2002.

(51) Int. Cl.[7] ..... A63H 33/04

(52) U.S. Cl. ..... 446/92; 446/376

(58) Field of Search ..... 446/92, 97, 99, 446/102, 137, 139, 375, 376, 321

(56) References Cited

U.S. PATENT DOCUMENTS

| | | | | | |
|---|---|---|---|---|---|
| 3,090,155 | A | | 5/1963 | Gordon | |
| 3,168,227 | A | | 2/1965 | Osmond | |
| 3,246,422 | A | | 4/1966 | Teagarden | |
| 3,375,604 | A | | 4/1968 | Alonso | |
| 3,660,926 | A | | 5/1972 | Lerner et al. | |
| 3,883,984 | A | | 5/1975 | Champeaux | |
| 4,038,775 | A | * | 8/1977 | Sato | 446/92 |
| 4,118,888 | A | | 10/1978 | Ogawa | |
| 4,144,669 | A | | 3/1979 | Ogawa | |
| 4,170,840 | A | | 10/1979 | Ogawa | |
| 4,176,492 | A | * | 12/1979 | Sims et al. | 446/92 |
| 4,183,173 | A | | 1/1980 | Ogawa | |
| 4,186,515 | A | * | 2/1980 | Ogawa | 446/99 |
| 4,206,564 | A | | 6/1980 | Ogawa | |
| 4,214,402 | A | | 7/1980 | Ogawa | |
| 4,233,777 | A | | 11/1980 | Inoue | |
| 4,342,173 | A | | 8/1982 | Otake | |
| 4,575,346 | A | | 3/1986 | Ogawa | |
| 4,767,505 | A | | 8/1988 | Satoh et al. | |
| 5,024,611 | A | | 6/1991 | Eckerle et al. | |
| 5,169,156 | A | | 12/1992 | Smollar | |
| 5,277,643 | A | | 1/1994 | Ejima | |
| 5,295,889 | A | * | 3/1994 | Ejima | 446/91 |
| 5,362,271 | A | | 11/1994 | Butt | |
| 5,380,233 | A | | 1/1995 | Numoto | |
| 5,727,717 | A | | 3/1998 | Vigne | |
| 5,810,638 | A | | 9/1998 | Wood | |
| 5,920,966 | A | | 7/1999 | Chen | |
| 6,062,938 | A | | 5/2000 | Meng-Suen | |
| 6,171,169 | B1 | | 1/2001 | Saunders | |
| 6,203,369 | B1 | * | 3/2001 | Feldman | 439/579 |
| 6,384,352 | B1 | | 5/2002 | Ellman et al. | |
| D459,416 | S | | 6/2002 | Rodgers | |
| 6,659,315 | B2 | * | 12/2003 | Talaric et al. | 223/66 |

* cited by examiner

*Primary Examiner*—Derris H. Banks
*Assistant Examiner*—Jamila Williams
(74) *Attorney, Agent, or Firm*—Kolisch Hartwell, P.C.

(57) ABSTRACT

In one embodiment, a magnetized joint for a toy figure. The magnetized joint may include a peg, and a socket for receiving and magnetically engaging the peg. In another embodiment, an appendage may be removably attached to a member of a toy figure by a magnetized joint, including a peg and a socket that engage coaxially. The joint may allow pivotal movement by allowing the peg to rotate within the socket.

9 Claims, 3 Drawing Sheets

TOY FIGURE WITH A MAGNETIZED JOINT

CROSS REFERENCE TO RELATED APPLICATIONS

The present application claims priority from U.S. Provisional Patent Application Ser. No. 60/405,133, filed Aug. 21, 2002, incorporated herein by reference in its entirety for all purposes.

FIELD OF THE INVENTION

The present invention relates to toy figures with joined members, and more particularly to members joined with magnetized joints that may be disposed within articulating regions of such toy figures.

BACKGROUND OF THE INVENTION

Toy figures, such as action figures and dolls, are classic toys that provide imaginative fun for many children. Removably attached appendages allow a child to configure a toy as they choose by, for instance, selecting from an assortment of different appendages. Examples of toys using magnets to attach appendages to a figure are found in U.S. Pat. Nos. 4,038,775, 4,118,888, 4,170,840, 4,176,492, 4,183,173, 4,186,515, 4,206,564, 5,277,643, 5,295,889, 5,380,233, 5,727,717, and 6,171,169, the disclosures of which are incorporated herein by reference.

SUMMARY OF THE INVENTION

In one embodiment, a magnetized joint for a toy figure is provided. The magnetized joint may include a peg, and a socket for receiving and magnetically engaging the peg. In another embodiment, an appendage may be removably attached to a member of the toy figure by a magnetized joint including a peg and a socket that engage coaxially. The joint may allow pivotal movement by allowing the peg to rotate within the socket.

DETAILED DESCRIPTION

Figure 1:
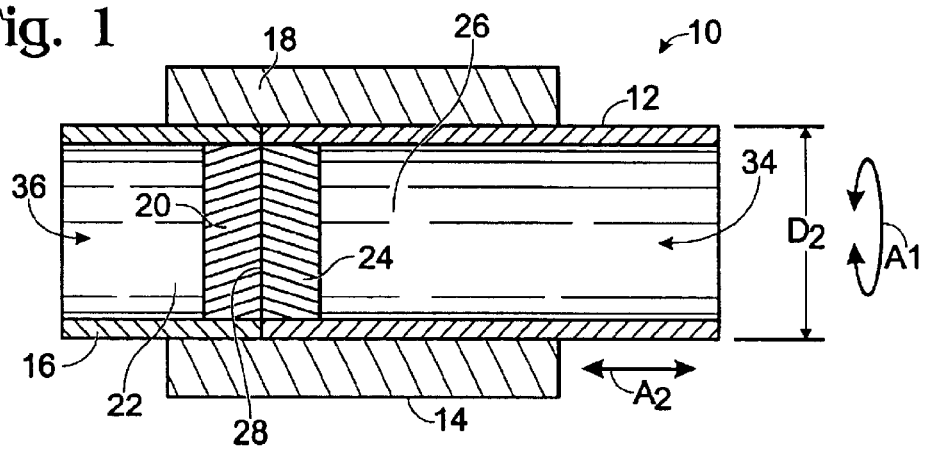
FIG. 1 is a cross-section of a magnetized joint, according to an embodiment of the invention.

FIGS. 1–4 depict a magnetized joint, generally indicated at 10, according to an embodiment of the present invention. As is seen in FIG. 1, joint 10 may include a magnetic peg 12, and a magnetic socket 14 for coaxially receiving and magnetically engaging the peg. Peg 12 and socket 14 may be elongate and may be substantially cylindrical, as depicted in the embodiment of FIGS. 1–4. However, it should be appreciated that other peg and socket configurations also may be used. Alternative configurations may include, for example, rectangular, square, oval, irregular, asymmetrical, or other cross-sectional shapes for the peg and/or socket.

Socket 14 may include an anchor 16, and a receiver 18. Anchor 16 and receiver 18 may both be in the form of a cylindrical sleeve. The anchor may be configured, for example, to anchor the socket within an articulating region of a toy figure. Alternatively, the receiver may be attached to a toy figure member. The receiver may be attached to the anchor and configured to slidably receive peg 12. Peg 12 may also be rotatable within receiver 18. As depicted in FIGS. 1–4, anchor 16 may be positioned coaxially within receiver 18. Attachment of the receiver to the anchor may be made, for example, by heat welding and/or by gluing, although other forms of adhesion or attachment may be suitable.

Anchor 16 may include a magnetic element, such as a socket magnet 20 disposed at a proximal end 22 of the anchor positioned in receiver 18. As indicated in FIGS. 1–4, the socket magnet may be attached coaxially within the anchor, and may be recessed within the anchor with an exposed face 20*a* aligned with the end of the anchor. The socket magnet may be configured to magnetically engage peg 12, as described below.

Peg 12 may include a magnetic element complementary to magnetic element 20, such as a peg magnet 24 disposed within an end 26 of the peg, to magnetically engage socket magnet 20 when the peg is inserted into the socket. The peg magnet may be attached coaxially within the peg as shown, and may be aligned with an exposed surface 24*a* approximately flush with the end of the peg. Receiver 18 may be configured for coaxially receiving peg 12, such that the peg magnet and the socket magnet may be substantially adjacent when the peg is inserted into the socket.

When the joint is fully engaged, i.e., when the peg is fully inserted into the socket, magnetic coupling between socket magnet 20 and peg magnet 24 may provide sufficient attractive force to keep proximal end 26 of the peg removably secured within the socket. When fully inserted into the socket, the peg may still be rotatable, as indicated by arrow $A_1$. Moreover, the peg may be removable from the socket by application of a sufficient tensional force, as indicated by arrow $A_2$.

Figure 2:
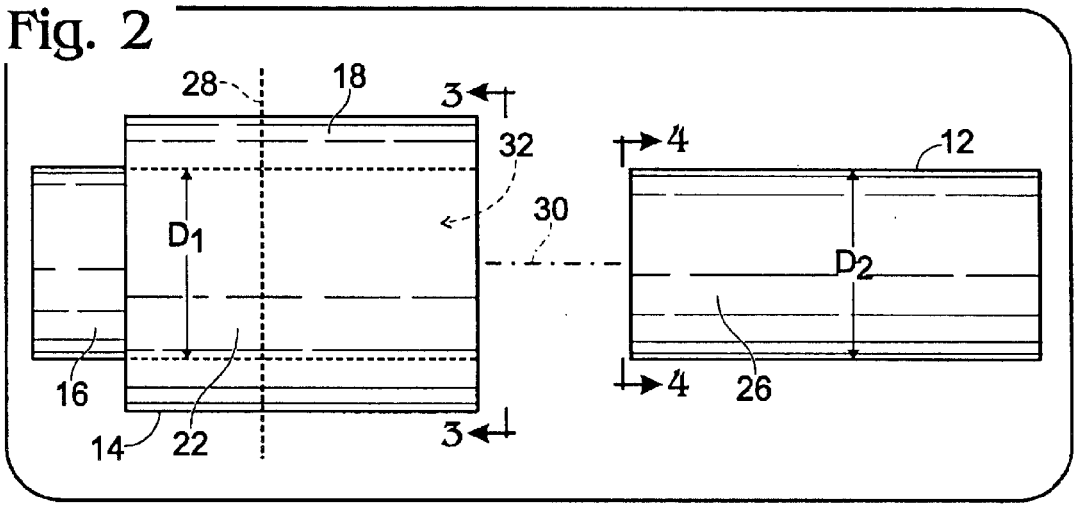
FIG. 2 is a partially exploded side elevational view of the magnetized joint of FIG. 1.
Figure 3:
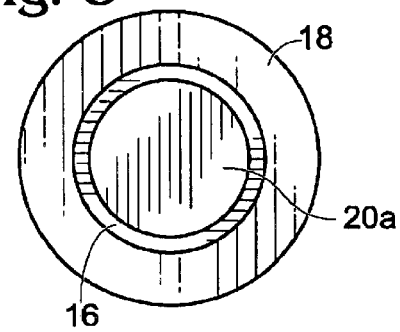
FIG. 3 is an end view of a socket of the magnetized joint of FIG. 2, taken along the line 3—3.
Figure 4:
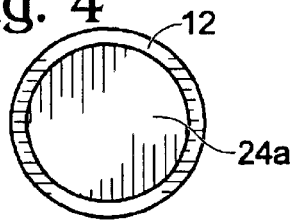
FIG. 4 is an end view of a peg of the magnetized joint of FIG. 2, taken along the line 4—4.

FIGS. 3 and 4 show cross-sections of the magnetized joint depicted in FIGS. 1 and 2. In the embodiment shown, the anchor, the receiver, and the peg are hollow cylinders. As described previously, in cases where the anchor and peg each include hollow portions, socket magnet 20 may be disposed coaxially within anchor 16, and peg magnet 24 may be disposed coaxially within peg 12. Socket magnet 20 may be attached to anchor 16, and peg magnet 24 may be attached to peg 12, by heat welding, gluing, and/or other suitable forms of adhesion.

It should be appreciated, however, that other configurations of joint 10 may be used. For instance, the peg or anchor may be substantially solid. This may increase the resistance of the joint to shear forces and bending moments. Additionally, the anchor may be in the form of a cap or plate covering the associated end of the receiver. Further, the receiver and anchor may be an integral unit. In such embodiments, engaging magnets still may be attached to end portions of the peg and anchor by the same general methods such as heat welding and/or gluing, among others, but the respective magnets each may be disposed on a proximal surface of, rather than coaxially within, the peg and anchor.

Generally, it is sufficient that one of magnetic elements 20 and 24 are a magnet, or are magnetically coupled to a magnet. However, for a given magnet, a stronger engaging force is realized by the use of two magnets. Furthermore, the magnetic elements may be positioned on facing sides of the peg and socket, rather than on facing ends.

The peg and the socket depicted in FIGS. 1–4 may be constructed of a generally non-flexible plastic, although many materials, including but not limited to various other plastics, metals, and woods may be used. The dimensions of magnetized joint 10 may be suitably chosen for use of the joint in toys and toy figures of various sizes. For example, in the cylindrical embodiment of FIGS. 1–4, the fully engaged joint assembly may be approximately 32 mm long and approximately 8 mm wide at its widest point (i.e., at the outer diameter of receiver 18).

Dimensions of the various components of magnetized joint 10 similarly may be chosen for convenience in various applications. For example, anchor 16 may be approximately 4 mm in inner diameter, 6 mm in outer diameter, and 10 mm in length; receiver 18 may be approximately 6 mm in inner diameter (but slightly larger than the outer diameters of the anchor and peg), 8 mm in outer diameter, and 10 mm in length; and peg 12 may be approximately 4 mm in inner diameter, 6 mm in outer diameter, and 16 mm in length.

It should be noted that in certain embodiments, such as the embodiment depicted in FIGS. 1–4, the position of socket magnet 20 within receiver 18 may influence the engagement position of peg 12 with respect to socket 14. In particular, overlap between the anchor and the receiver may limit the depth of the socket, with the socket magnet forming a stop or seat for the peg, as may be seen in FIG. 1. In general, the receiver may be made deep enough to secure the peg in the socket and to allow the peg to tolerate nominal bending moments, when the peg is fully inserted into the socket.

FIG. 2 depicts peg 12 and socket 14 disengaged from each other. An engagement plane 28 defines the plane in which proximal ends 26 and 22 of the peg and socket are coaxially and magnetically fully engaged. As shown, receiver 18 may be disposed with its long axis 30 perpendicular to the engagement plane, so that the engagement plane may intersect the receiver radially. Also, as indicated, the receiver may contain a cylindrical void 32 with inner diameter $D_1$ such that it may coaxially and securely receive a peg having a diameter $D_2$ less than $D_1$.

Socket magnet 20 and peg magnet 24 may be configured to securely magnetically engage each other along engagement plane 28 when the peg is inserted into the socket, and may be constructed in a manner suitable for this engagement. In embodiments where the peg and anchor are hollow cylinders, the dimensions of the magnets may be chosen so that the magnets fit securely inside cylindrical voids 34 and 36 of the peg and the anchor, respectively. For example, in the embodiment of FIGS. 1–4, magnets 20 and 24 are similar in construction, and each magnet is approximately 4 mm in diameter and approximately 1 mm thick.

Figure 6:
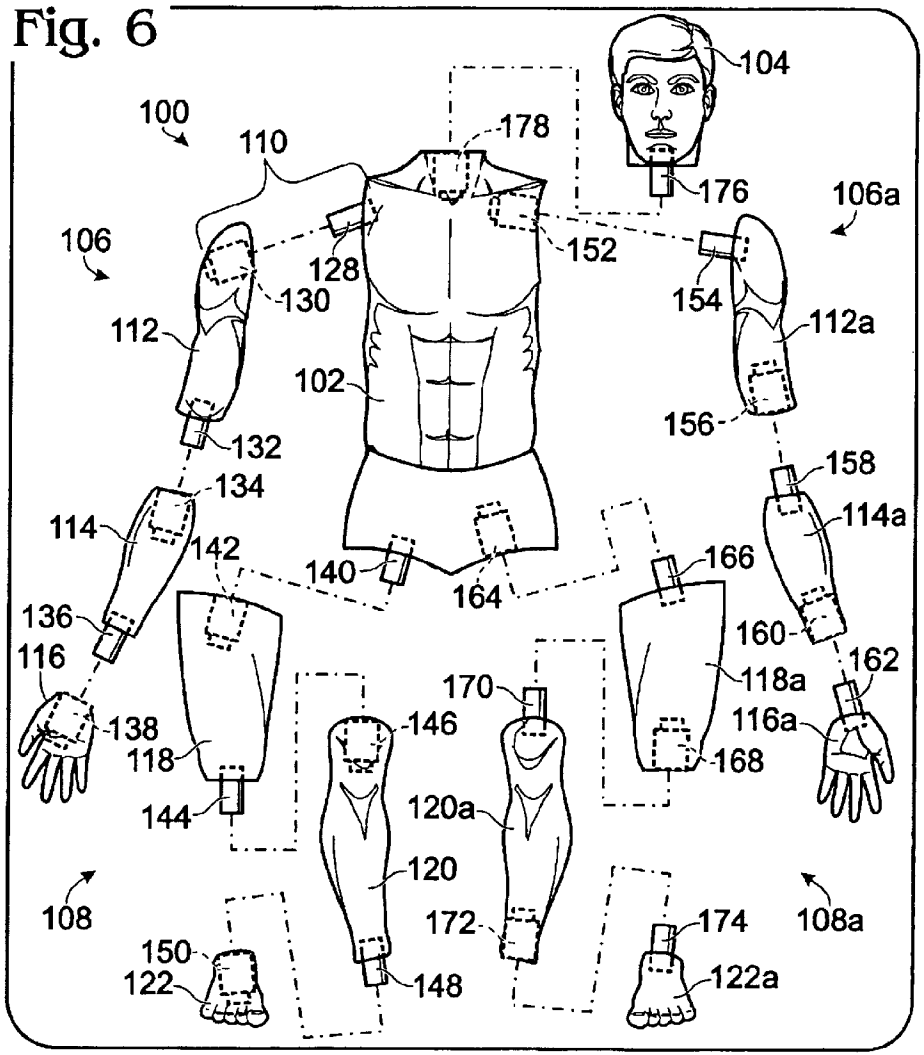
FIG. 6 is a partially exploded front elevational view of the toy figure of FIG. 5, depicting several appendages detached.
Figure 5:
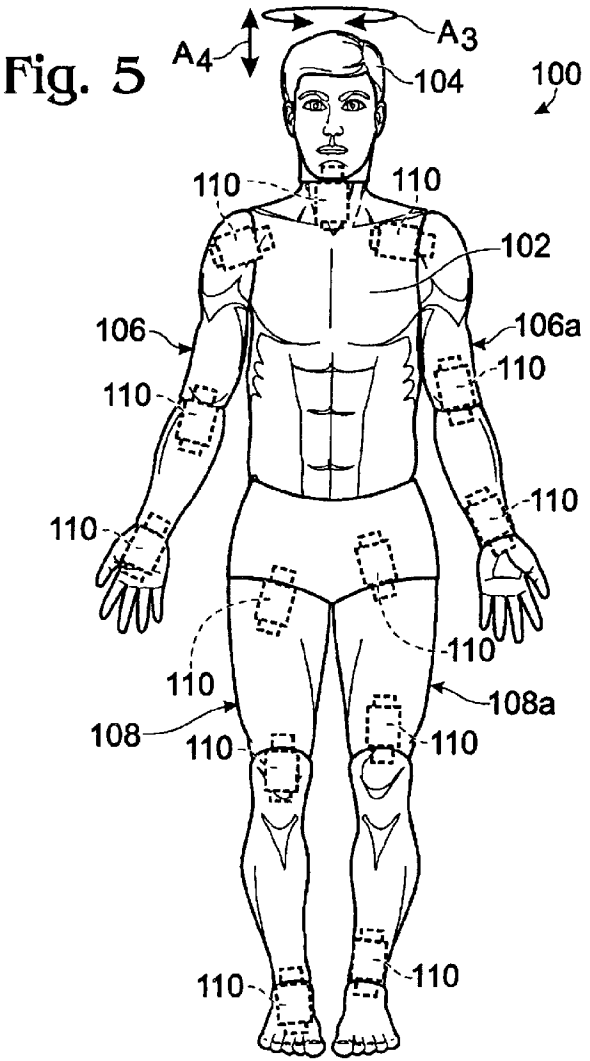
FIG. 5 is a front elevational view of a toy figure including several hidden magnetized joints, according to an embodiment of the invention.

Turning now to FIGS. 5 and 6, a toy figure 100 is shown representing an embodiment of the present invention. FIG. 5 shows a plurality of magnetized joints of the toy figure in phantom. Toy figure 100 may include a body or torso member 102, and a number of other figure members in the form of appendages that may be removably attached to the body member. The appendages, which may be articulating appendages, may include a head portion 104, arm portions 106, 106*a*, and leg portions 108, 108*a*.

Magnetized joints 110 may be disposed in various locations throughout toy figure 100, to detachably connect the appendages to the body of the toy figure. Magnetized joints may also connect appendages to each other, in cases where the appendages themselves include detachable components. As is further described below, joints 110 may be similar in function and construction to magnetized joint 10 shown in FIGS. 1–4.

FIG. 6 shows a partially exploded view of the toy figure of FIG. 5, with several appendages detached from each other and from the body member of the toy figure. As depicted in FIG. 6, arm portions 106, 106*a* and leg portions 108, 108*a* may in some embodiments include multiple detachable portions. For example, arm portions 106, 106*a* may include detachable upper arm portions 112, 112*a*, detachable forearm portions 114, 114*a*, and/or detachable hand portions 116, 116*a*. Similarly, leg portions 108, 108*a*may include detachable thigh portions 118, 118*a*, detachable lower leg portions 120, 120*a*, and/or detachable foot portions 122, 122*a*. These various appendages may be removably attached to body member 102, and/or to each other, with magnetized joints 110.

Magnetized joints 110, for removably attaching appendages to each other and/or to a toy figure body, may be similar in construction to magnetized joint 10, which has already been described in detail and shown in one embodiment in FIGS. 1–4. In particular, each magnetized joint may include a peg, and a socket for coaxially receiving and magnetically engaging the peg. The peg may have a peg magnet disposed at a distal end, and the socket may have a magnet that cooperates with the peg magnet to removably secure the peg within the socket.

As depicted in FIGS. 5 and 6, each removably attachable appendage may have an attached peg or socket, and the figure member to which it interlocks may have the complementary socket or peg attached. For example, as shown in FIG. 6, the left side of body member 102 may have a peg 128 attached for engaging a socket 130 in upper arm portion 112. Upper arm portion 112 may have socket 130 for engaging body member peg 128, and a peg 132 attached for engaging a socket 134 in forearm portion 114. Forearm portion 114 may have socket 134 for engaging upper arm peg 132, and a peg 136 attached for engaging a socket 138 in hand portion 116.

Similarly, the left side of body member 102 may have a peg 140 attached for engaging a socket 142 in thigh portion 118. Thigh portion 118 may have socket 142 for engaging body member peg 140, and a peg 144 attached for engaging a socket 146 in lower leg portion 120. Lower leg portion 120 may have socket 146 for engaging thigh peg 144, and a peg 148 attached for engaging a socket 150 in foot portion 122.

An alternative arrangement of magnetized joints is depicted on the right side of toy figure 100 in FIGS. 5 and 6. As shown, the right side of body member 102 may have a socket 152 for engaging a peg 154 attached to upper arm portion 112*a*. Upper arm portion 112*a* may have peg 154 attached for engaging body member socket 152, and a socket 156 for engaging a peg 158 attached to forearm portion 114*a*. Forearm portion 114*a* may have peg 158 attached for engaging upper arm socket 156, and a socket 160 for engaging a peg 162 attached to hand portion 116*a*.

Similarly, the right side of body member 102 may have a socket 164 for engaging a peg 166 attached to thigh portion 118*a*. Thigh portion 118*a* may have peg 166 attached for engaging body member socket 164, and a socket 168 for engaging a peg 170 attached to lower leg portion 120*a*. Lower leg portion 120*a* may have peg 170 attached for engaging thigh socket 168, and a socket 172 for engaging a peg 174 attached to foot portion 122*a*.

While two distinct configurations of pegs and sockets are depicted on the left and right sides, respectively, of toy figure 100, various other combinations and permutations are possible. For example, head portion 104 is shown having a peg 176 attached for engaging a socket 178 in body member 102. However, a head portion with a socket to engage a corresponding peg attached to the body member is an obvious and equivalent configuration.

Magnetized joints 110 may attach various appendages of toy figure 100 to each other and/or to body member 102 such that each appendage may rotate and, alternatively, may be removed. In other words, the magnetized joints disposed in toy FIG. 100 may be configured so that the various appendages of the toy figure 100 may articulate, in addition to being detachable. In this manner, for example, head portion 104 may be rotated while remaining attached to body member 102, as represented by arrow $A_3$, and also may be detached, as represented by arrow $A_4$. Similarly, other appendages of toy figure 100 may be rotated and/or detached.

The magnetized joints of the present invention may, in light of the above, be particularly well suited for use in articulating regions of a toy figure. Such articulating regions may include any and all regions of the human body that naturally contain articulating surfaces, such as the neck, shoulders, elbows, wrists, and fingers, as well as the hips, knees, ankles, and toes. Additionally, toy figures, such as action or mechanical toy figures, may contain articulating regions not normally found in normal human physiology, in which magnetized joints may be used to facilitate articulation.

Although it is within the scope of this invention for all or any subset of appendages to be removably attached using a magnetized joint, in some embodiments, some of the appendages may be secured by means of differing joint assemblies. For example, some appendages may be removably attached using magnetized joints, some appendages may be removably attached using joints of other construction, and/or some appendages may be non-removably attached.

Figure 7:
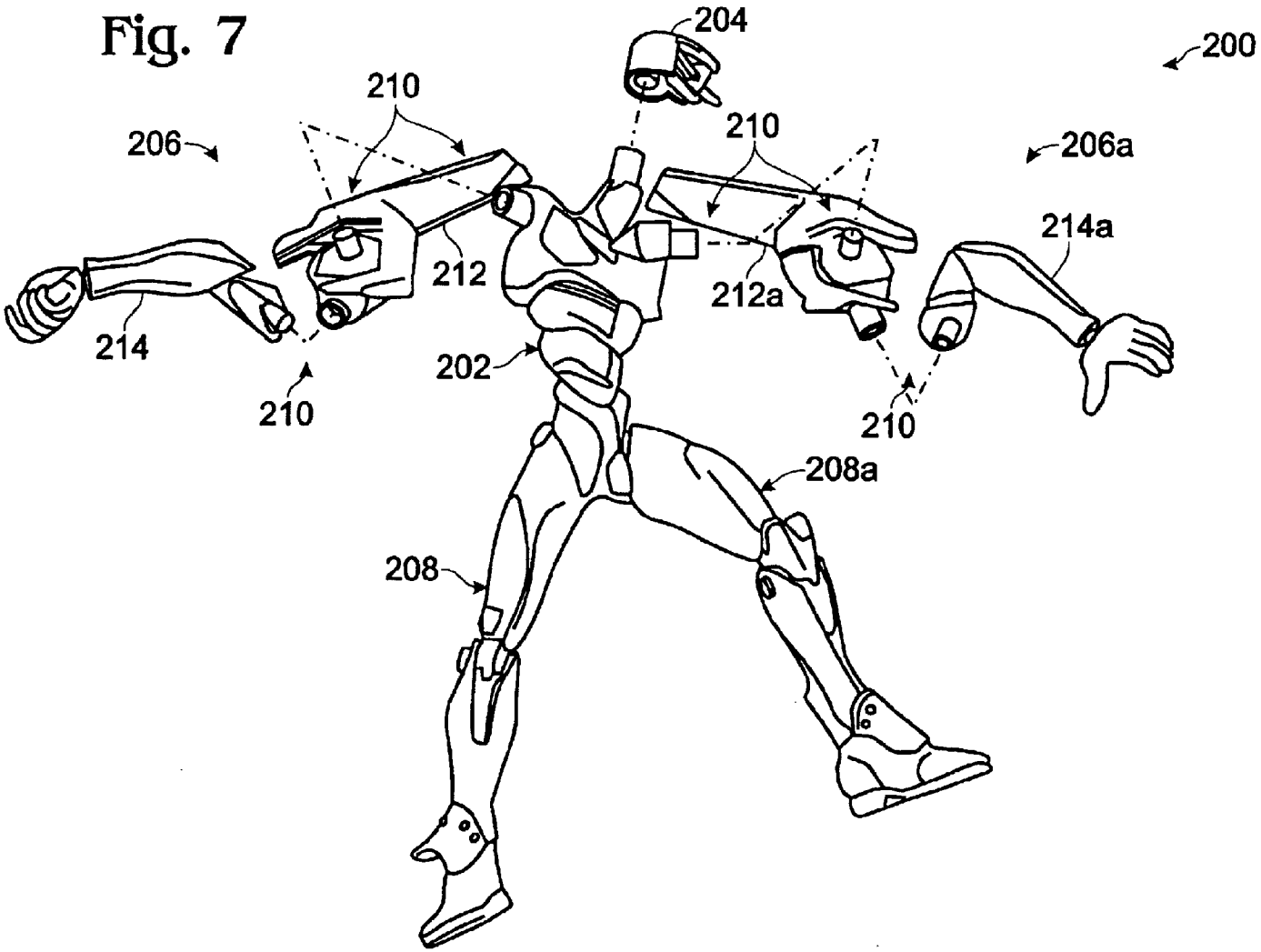
FIG. 7 is a partially exploded front elevational view of another embodiment of a toy figure including several magnetized joints.

FIG. 7 shows a partially exploded view of an embodiment of a toy figure 200, including several appendages removably attached with magnetized joints, and several appendages that are non-removably attached. In particular, figure 200 includes a torso portion 202, a head portion 204, arm portions 206, 206*a*, leg portions 208, 208*a*, and a plurality of magnetized joints 210. In the partially exploded view of FIG. 7, several appendages are shown detached from each other, and from the body member of the toy figure.

As depicted in FIG. 7, arm portions 206, 206*a* may include detachable upper arm portions 212, 212*a*, and detachable forearm portions 214, 214*a*, removably attached to body member 202, and/or to each other, with magnetized joints 210. Magnetized joints 210 may be similar in construction to magnetized joints 10 and 110, which have already been described in detail in this disclosure. In particular, each magnetized joint 210 may include a peg, and a socket for coaxially receiving and magnetically engaging the peg. The peg may have a peg magnet disposed at a distal end, and the socket may have a magnet that cooperates with the peg magnet to removably secure the peg within the socket.

While the present description has been provided with reference to the foregoing embodiments, those skilled in the art will understand that many variations may be made therein without departing from the spirit and scope defined in the following claims. The description should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring, nor excluding, two or more such elements.

I claim:

1. A joint for a toy figure comprising:

a substantially cylindrical hollow receiver;

a substantially cylindrical anchor disposed within an articulating region of a toy figure, the anchor having an end portion attached coaxially within the receiver such that the receiver and the anchor are at least partially overlapping;

a substantially cylindrical first magnet attached coaxially within the end portion of the anchor;

a substantially cylindrical peg including an end configured to slide coaxially into the receiver; and a second magnet disposed at the end of the peg and configured to magnetically attract and engage the first magnet when the peg is positioned in the receiver.

2. The joint of claim 1, wherein a portion of the peg extends outside the socket.

3. The joint of claim 1, further comprising a torso member and at least on appendage adapted to be coupled to the torso member via the joint.

4. The toy figure of claim 1, wherein the peg is elongate.

5. The toy figure of claim 4, wherein the socket is elongate.

6. The toy figure of claim 3, wherein the at least one appendage includes a head portion.

7. The toy figure of claim 6, wherein the at least one appendage further comprises arm portions and leg portions, and wherein the at least one joint includes corresponding joints for connecting the arm portions and the leg portions to the body member.

8. The toy figure of claim 7, wherein the arm portions include upper arm portions and forearm portions, wherein the leg portions include thigh portions and lower leg portions, and wherein the at least one joint includes corresponding joints for connecting the forearm portions to the upper arm portions and for connecting the lower leg portions to the thigh portions.

9. The toy figure of claim 8, further comprising foot portions and hand portions, and wherein the at least one joint includes corresponding joints for connecting the foot portions to the lower leg portions and for connecting the hand portions to the forearm portions.

* * * * *